US005558017A

United States Patent [19]

Berger et al.

[11] Patent Number: 5,558,017

[45] Date of Patent: Sep. 24, 1996

[54] ROLL STAND

[75] Inventors: Bernd Berger, Kaarst; Peter Reinthal, Hemer; Manfred Benfer, Iserlohn, all of Germany

[73] Assignee: Sundwiger Eisenhutte Maschinenfabrik GmbH & Co., Hemer-Sundwig, Germany

[21] Appl. No.: 380,750

[22] Filed: Jan. 30, 1995

[30] Foreign Application Priority Data

Feb. 28, 1994 [DE] Germany ..... 44 06 454.3

[51] Int. Cl.[6] ..... B30B 3/04

[52] U.S. Cl. ..... 100/93 RP; 72/242.4; 72/250; 100/160; 100/173

[58] Field of Search ..... 72/242.4, 250; 100/93 RP, 160, 168, 169, 173, 174

[56] References Cited

U.S. PATENT DOCUMENTS

| | | | |
|---|---|---|---|
| 2,353,288 | 7/1944 | Bennewitz | 72/250 |
| 3,147,648 | 9/1964 | Sendzimir | 72/242.4 |
| 4,039,107 | 8/1977 | Boley | 72/250 |
| 5,085,140 | 2/1992 | Kunig | 100/173 |
| 5,142,896 | 9/1992 | Berger et al. | 72/242.4 |

FOREIGN PATENT DOCUMENTS

| | | | |
|---|---|---|---|
| 0513631A1 | 11/1992 | European Pat. Off. . | |
| 811831 | 8/1951 | Germany | 72/250 |
| 58-125310 | 7/1983 | Japan . | |
| 58-125311 | 7/1983 | Japan . | |
| 60-221114 | 11/1985 | Japan . | |
| 61-042407 | 2/1986 | Japan . | |
| 576131 | 10/1977 | U.S.S.R. | 72/250 |

*Primary Examiner*—David Scherbel
*Assistant Examiner*—Terrence R. Till
*Attorney, Agent, or Firm*—Meltzer, Lippe, Goldstein, et al.

[57] ABSTRACT

In a roll stand, more particularly a cluster roll stand, having guard plates (15, 21) which are disposed opposite one another in pairs above and below the strip (B) processed in the roll stand in the run-in zone (E) and run-out zone (A) of the roll stand and which extend into the roll stand substantially as far as the stand working rolls (1, 8) supported by supporting rolls (2–6*a*, 9–13*a*) and/or undriven supporting rollers, the lower guard plates (21) each being connected to the lower member (14) of the stand pivotably around a pivot (22) disposed axis-parallel with the working rolls (1, 8), the objective was to improve the protective effect of the guard plates (15, 21), while at the same time reducing expenditure on the lifting means required to lift the upper working roll (1). This is achieved by the features that the upper guard plates (15) are each connected to the vertically adjustable upper member (7) of the stand pivotably around a pivot (16) also disposed axis-parallel with the working rolls (1, 8) and each have at their tip associated with the working rolls (1, 2) supporting means (19) which entrain the upper working roll (1) when the guard plates (15) are pivoted in the direction of the upper member (7) of the stand.

10 Claims, 4 Drawing Sheets

ROLL STAND

Figure 1:
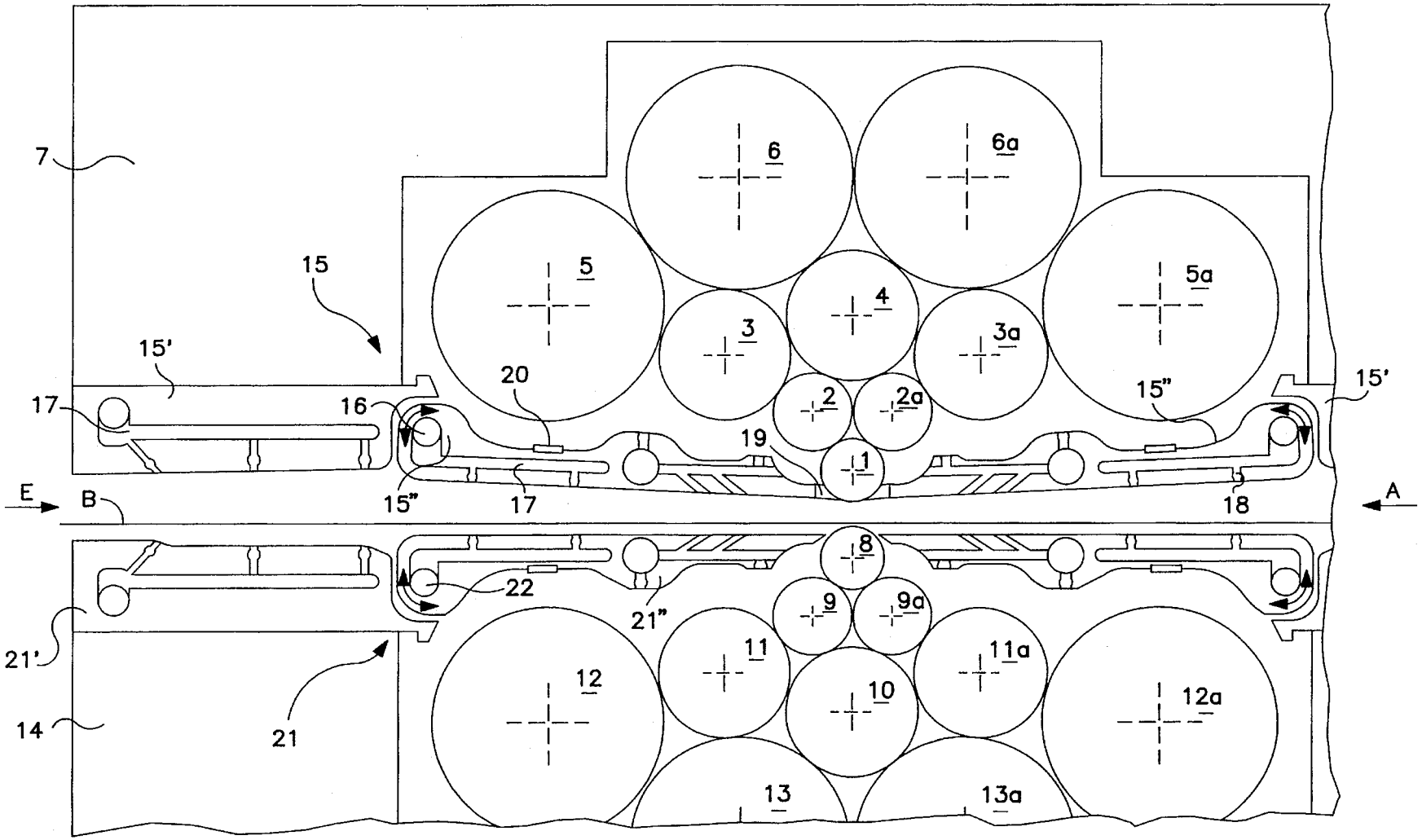

The invention relates to a roll stand, more particularly a cluster roll stand, having guard plates which are disposed opposite one another in pairs above and below the strip processed in the roll stand in the run-in zone and run-out zone of the roll stand and which extend into the roll stand substantially as far as the stand working rolls supported by supporting rolls and/or undriven supporting rollers, the lower guard plates each being connected to the lower member of the stand pivotably around a pivot disposed axis-parallel with the working rolls.

The guard plates used in roll stands protect the supporting rolls against damage which may be caused, for example, by the cracking of the strip processed in the stand, if the strip ends are suddenly deflected in the direction of rolls. The lower guard plates also assist the introduction of a fresh strip to be processed and the removal of a finished strip, while at the same time ensuring that the working rolls of the stand are not damaged. In the prior art roll stand the guard plates are also formed with ducts and nozzles via which coolant is supplied to the plate processed in the roll stand.

The aforementioned requirements mean that the guard plates must extend as close as possible to the working rolls both during the introduction and removal of the strip and also in the operational position of the roll stand. This also means that the position of the guard plates in relation to the working rolls must be designed variable in dependence on roll size. To this end in one of the prior art cluster roll stands the upper guard plates are constructed to be displaced horizontally, so that they can be moved into the run-in and run-out zones of the roll stand in dependence on the size of the working rolls.

The advantage of that design of the guard plates is that if the strip cracks, due to their large-area support the guard plates can reliably intercept the vertically deflecting strip ends. However, one disadvantage of the prior art apparatus is that the upper guard plates are at a different distance from the strip if working rolls of different sizes are used; with large working rolls the distance between the upper guard plates and the strip may become large enough to reduce their protective effect. Another disadvantage of the known roll stand is that it requires expensive lifting means in order to lift the working roll, which has no retaining means during roll operation, to accompany the raising of the upper member of the stand, for example, when the strip to be processed is changed.

It is an object of the invention to improve the protective effect of the guard plates used on a roll stand of the kind specified, while at the same time reducing expenditure on the raising means required to lift the working roll.

This problem is solved according to the invention by the features that the upper guard plates are each connected to the vertically adjustable upper member of the stand pivotably around a pivot also disposed axis-parallel with the working rolls and each have at their tip associated with the working rolls supporting means which entrain the upper working roll when the guard plates are pivoted in the direction of the upper member of the stand.

In the roll stand according to the invention the pivotability of each upper guard plate also makes it possible for the pivoting angle of each of the upper and lower guard plates to be so directed that at their ends associated with the working rolls the plates are at the same distance from the strip. This adjustment of the distance of the guard plates is independent of the size of the working rolls used on the stand.

At the same time, the pivotability of the upper guard plates does not limit their effectiveness since, for example, if a strip end jumps upwards when the strip cracks, the particular guard plate concerned is moved to bear against the rolls disposed above said plate, which therefore receives additional support. In this way, in a roll stand designed according to the invention a high degree of operational security is ensured independently of the size of the working rolls used on the stand.

Since moreover the guard plates have supporting means at their tips associated with the working rolls, the drives required for pivoting the guard plates can at the same time be used for lifting the working roll when the roll stand is opened. Unlike the prior art, the roll stand according to the invention therefore requires no additional lifting means to lift the working roll.

The versatility of the apparatus according to the invention can be further enhanced by the feature that the guard plates are each divided into an inner portion associated with the working rolls and an outer portion, each inner portion being pivotable and the outer portion being rigidly connected to the upper member or the lower member of the stand respectively. This design enables the pivoting range and therefore the adaptability of the main parts of the guard plates to be increased without any reduction in operational reliability.

As in the case of the aforediscussed roll stand, in the stand according to the invention also the guard plates can take the form of cooling plates which have ducts and outlet nozzles for a cooling medium to be applied to the strip.

Since if operations are interrupted by the strip cracking, the rolls disposed above the upper guard plates support the latter, it makes sense if on their sides associated with the supporting rolls and undriven rollers each of the guard plates has cushioning members in the zone of the immediately adjacent rolls or undriven rollers. The cushioning members can take the form of bronze inserts.

Similarly, the supporting means for the upper working roll can take the form of bronze members. In addition, any damage to the surface of the working rolls contacting the strip by the supporting means can be precluded by the feature that the supporting means for the upper working roll are disposed at the outer marginal edge of the guard plates.

To enable the rolls disposed below the lower guard plates to have a supporting effect in relation thereto, according to the invention in the operational position of the roll stand, the lower pivotable guard plates bear against stops which yield under overloading. In that case both the lower guard plates and the corresponding upper guard plates should have cushioning inserts which prevent the particular supporting rolls from getting damaged in case of a malfunction.

A constant distance between the guard place tips associated with the working rolls and the strip can be achieved in a simple manner by the feature that in the working position of the roll stand, each upper guard plate bears against a stop of the associated lower guard plate or of the lower member of the stand.

Figure 2:
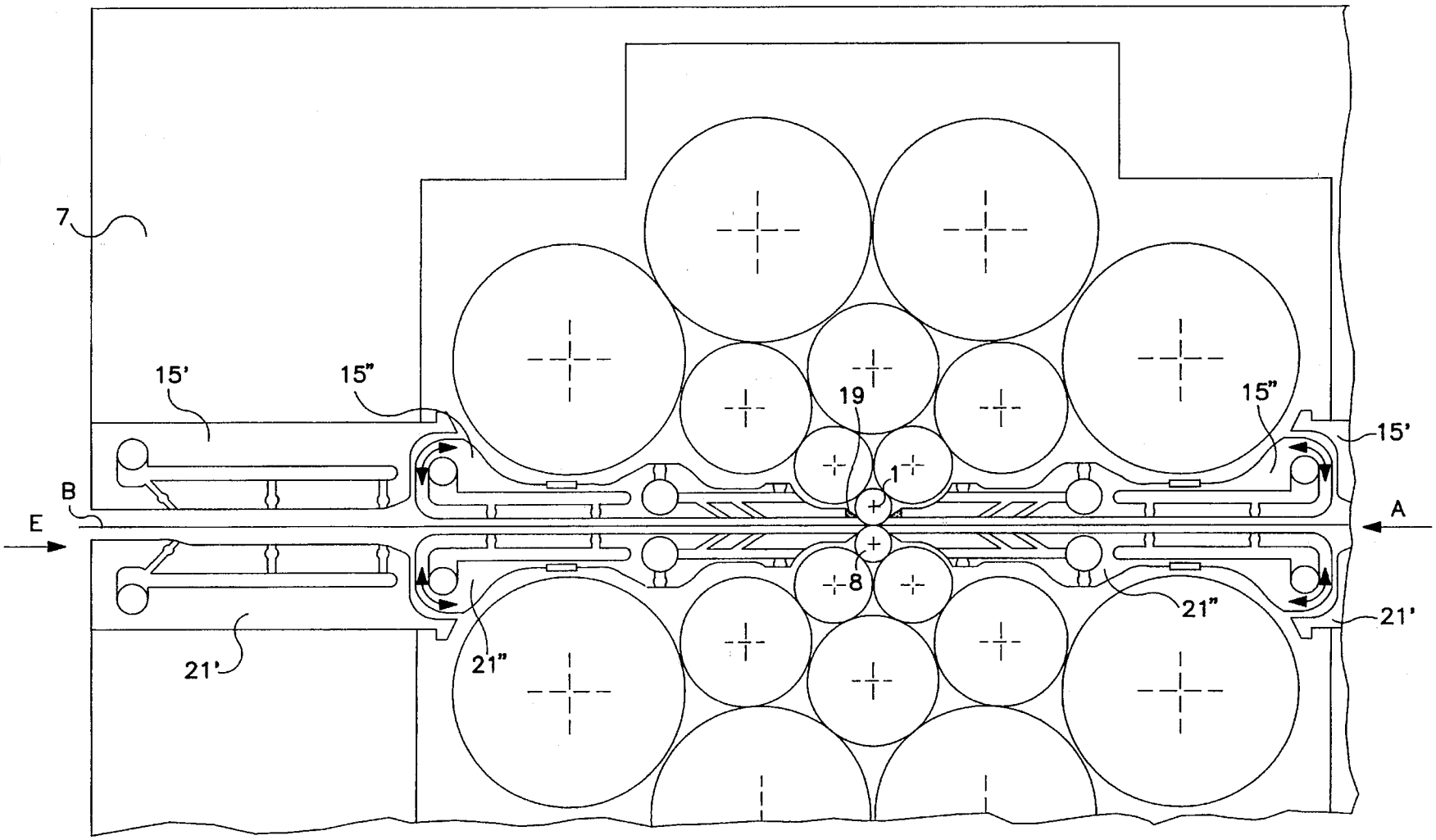
Figure 3:
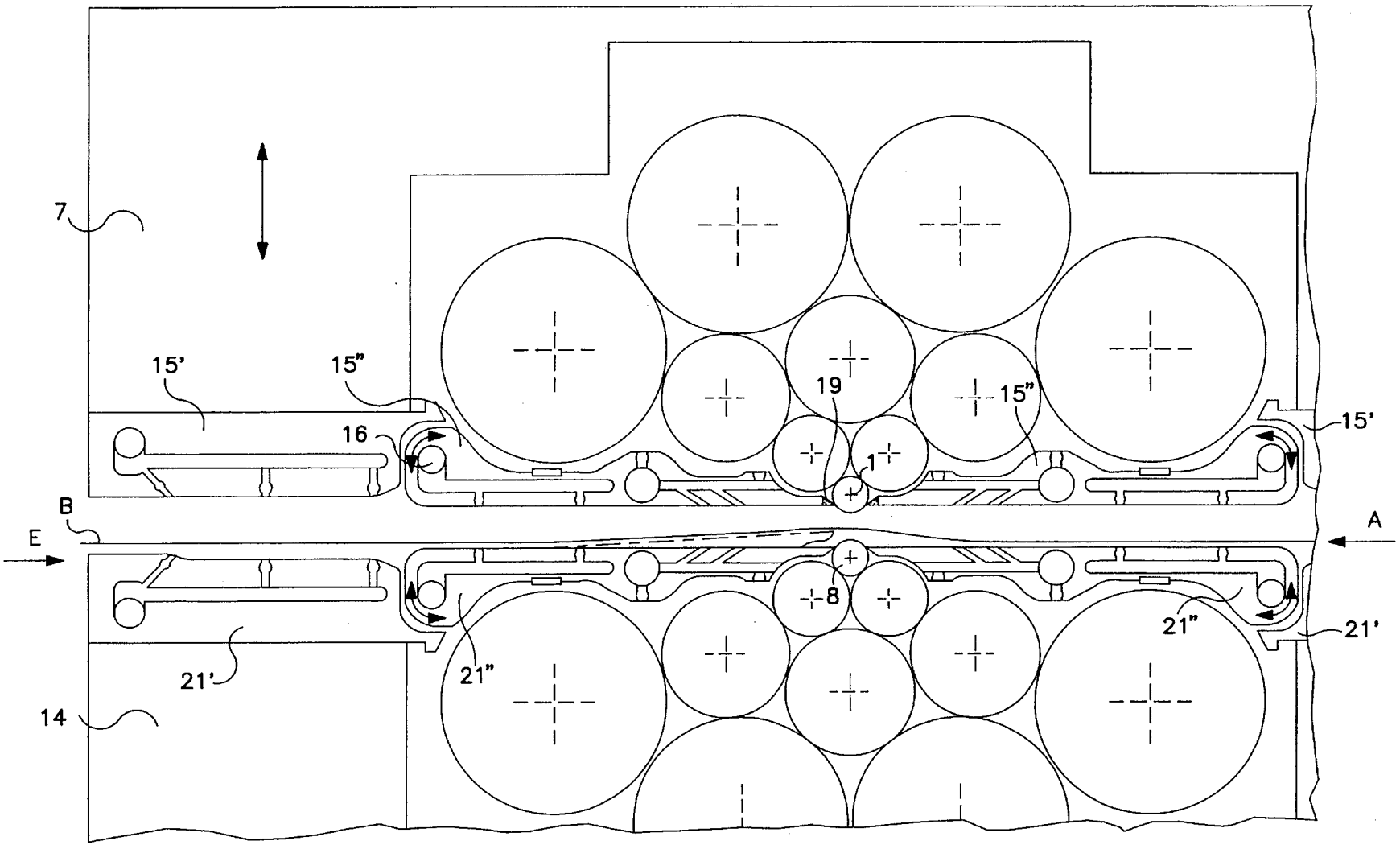
Figure 4:
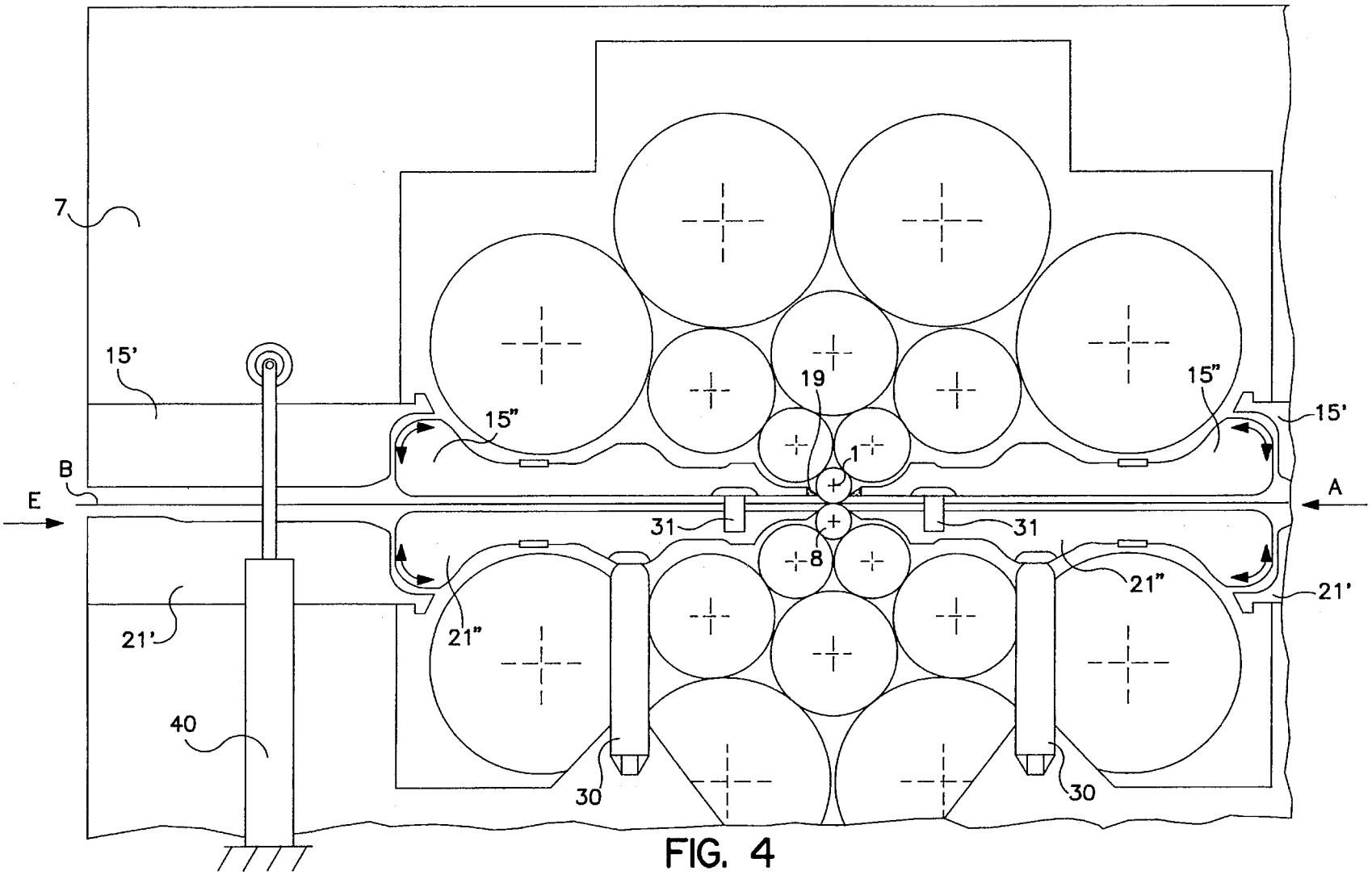

An embodiment of the invention will now be explained in greater detail with reference to the drawings, wherein:

FIG. 1 is a section through the run-in and run-out zones of an opened cluster roll stand having large working rolls, FIG. 2 shows the roll stand illustrated in FIG. 1 in the closed position and having working rolls which have a smaller diameter than those shown in FIG. 1, FIG. 3 shows the roll stand illustrated in FIG. 2 during the introduction of a fresh strip for processing, and FIG. 4 is another embodiment of the roll stand illustrated in FIG. 2.

Referring to the drawings, in a cluster roll stand an upper working roll 1 is supported via intermediate rolls 2, 2*a*, 3, 3*a*, 4 and supporting rolls 5,5*a*, 6, 6*a*. The intermediate rolls 2, 2*a*, 3, 3*a*, 4 and the supporting rolls 5, 5*a*, 6, 6*a* are mounted in an upper member 7 of a stand and can be vertically adjusted by adjustment means 40. together therewith. Correspondingly, a lower working roll 8 is supported via intermediate rolls 9, 9*a*, 10, 11, 11*a* and supporting rolls 12, 12*a*, 13, 13*a*. The intermediate rolls 9, 9*a*, 10, 11, 11*a* and the supporting rolls 12, 12*a*, 13, 13*a* are mounted in a lower member 14 of the stand. The intermediate rolls 9, 9*a*, 10, 11, 11*a* and the supporting rolls 12, 12*a*, 13, 13*a* can be vertically adjusted inside the lower part 14 of the stand, to enable pairs of working rolls 1, 8 of different diameter to be used on the stand. This ensures that a strip B to be processed is always guided rectilinearly through the roll stand, independently of the diameter of the working rolls 1, 8.

A comparison between FIGS. 1 and 3 makes this clear; in the roll stand shown in FIG. 1 working rolls 1, 8 of large diameter are used, while in the stand shown in FIG. 3 the working rolls 1, 8 have a small diameter.

Disposed in the run-in and run-out zone E, A of the roll stand is an upper guard plate 15 which takes the form of a cooling plate and which is divided into an immobile first portion 15' and a second portion 15" pivotable by means of hydraulic drives (not shown). The first portion 15' of the guard plate 15 is rigidly attached to the upper member 7 of the stand. Provided at its end associated with the supporting roll 5 is a pivot 16 for the pivotable portion 15" of the upper guard plate. The two portion 15', 15" of the guard plate 15 are formed with ducts 17 and nozzles 18 via which a cooling medium can be applied to the strip B processed in the roll stand.

Attached on both sides to the outer sides in the zone of the tip of the pivotable guard plate portion 15" associated with the upper working roll 1 are bronze supporting means 19 via which the working roll 1 is retained in the raised position when the roll stand is in the opened position shown in FIG. 1. Bronze cushioning members 20 are also inserted in the side of the pivotable guard plate portion 15" associated with the supporting rolls in each case opposite the nearest adjacent supporting roll 5 and intermediate roll 3.

Disposed opposite the upper guard plate 15 in the run-in and run-out zones E,A of the roll stand is a lower guard plate 21, also taking the form of a cooling plate, which is divided into a fixed first portion 21', rigidly connected to the lower member 14 of the stand, and a second portion 21" pivotable by means of a hydraulic drive (also not shown). The pivot 22 for the second portion 21" of the lower guard plate 21 is again provided at the front edge, associated with the supporting roll 12, of the first portion 21'.

When the roll stand is closed, as shown in FIG. 2, the pivotable portion 21" of the lower guard plate 21 bears against a stop 30 (FIG. 4) of the lower member 14 of the stand which yields resiliently under overloading, so that its distance from the strip B processed in the roll stand is determined. At the same time the pivotable portion 15" of the guard plate 15 bears against a stop 31 (FIG. 4) formed on the pivotable portion 21" of the lower guard plate 21 or on the lower member 14 of the stand. In this way also its distance from the strip B during processing is determined. At the same time there is no contact between any of the rolls of the stand and the particular pivotable portion 15", 21" of the guard plates 15, 21.

On completion of rolling, the working rolls 1, 2 are relieved of pressure. Then the pivotable portion 15" of the upper guard plate is pivoted upwards, until the supporting means 19 attached thereto bear against the upper working roll 1. The same thing happens with the upper guard plate (not shown) in the run-out zone of the roll stand. Then the upper member 7 of the stand is raised, the working roll 1 now bearing against the supporting means 19 of the guide plate 15" being entrained. Then the pivotable portion 21" of the lower guard plate 21 associated with the run-in zone E is pivoted upwards (position shown in chain-dot lines in FIG. 3) so that the lower working roll 2 is not damaged and the finished sheet is removed and the fresh sheet to be processed is introduced.

After the introduction of the fresh sheet B to be processed, the movable portion 21" of the lower guard plate 21 is pivoted downwards until it bears against the lower stop of the lower member 14 of the stand. The roll gap previously still opened between the working rolls 1, 2 is then closed by the lowering of the upper member 7 of the stand. At the same time the pivotable portion 15" of the upper guard plate 15 bears against the associated stop of the lower guard plate 21 or of the lower member 14 of the stand, so that the upper working roll 1 is again freely rotatable.

We claim:

1. A roll stand, comprising:

a vertically adjustable upper member, a lower member, at least one upper working roll, at least one lower working roll, a plurality of upper and lower supporting rolls, supporting said upper and lower working rolls, respectively, a plurality of upper and lower guard plates disposed opposite one another in pairs, above and below a strip which is rolled in said roll stand, said upper and lower guard plates extending into said roll stand to said upper and lower working rolls, respectively, wherein each of said upper guard plates is pivotably connected to said vertically adjustable upper member, around a pivot disposed axially parallel to said upper working roll, and wherein each of said lower guard plates is pivotably connected to said lower member, around a pivot disposed axially parallel to said lower working roll, and wherein each of said upper guard plates includes a supporting element associated with said upper working roll, such that said supporting element engages said working roll when said upper guard plate is pivoted in the direction of said upper member of said roll stand.

2. The roll stand of claim 1, wherein each of said upper and lower guard plates is divided into an inner portion and an outer portion, each said upper and lower guard plate inner portion being pivotably associated with said upper and lower working rolls, respectively, and each said upper guard plate outer portion being rigidly connected to said vertically adjustable upper member, and each said lower guard plate outer portion being rigidly connected to said lower member.

3. The roll stand of claim 1 wherein said upper and lower guard plates contain ducts and outlet nozzles for transporting a cooling medium to said strip.

4. The roll stand of claim 1 wherein each of said upper and lower guard plates includes a cushioning member between said guard plate and said supporting rolls which are immediately adjacent to said guard plate.

5. The roll stand of claim 4 wherein said cushioning members are bronze inserts.

6. The roll stand of claim 1 wherein said supporting elements for said upper working roll are bronze elements.

7. The roll stand of claim 1 wherein each of said supporting elements for said upper working roll is disposed on an edge of each of said upper guard plates, said edge being adjacent to said upper working roll.

8. The roll stand of claim 1 wherein each of said lower guard plates, when in the working position of said roll stand, bears against a stop which yields when overloaded.

9. The roll stand of claim 1 wherein each of said upper guard plates, when in the working position of said roll stand, bears against said stop of said lower guard plate associated with said upper guard plate.

10. The roll stand of claim 1 wherein each of said upper guard plates, when in the working position of said roll stand, bears against a stop of said lower member.

* * * * *